US007143471B2

(12) United States Patent
Moshenrose

(10) Patent No.: US 7,143,471 B2
(45) Date of Patent: Dec. 5, 2006

(54) VACUUM CLEANER ATTACHMENT

(75) Inventor: Paul A. Moshenrose, Ocean Springs, MS (US)

(73) Assignee: Oreck Holdings, LLC, Cheyenne, WY (US)

( * ) Notice: Subject to any disclaimer, the term of this patent is extended or adjusted under 35 U.S.C. 154(b) by 638 days.

(21) Appl. No.: 10/679,929

(22) Filed: Oct. 6, 2003

(65) Prior Publication Data

US 2005/0071948 A1 Apr. 7, 2005

(51) Int. Cl.
*A47L 5/00* (2006.01)

(52) U.S. Cl. ..... 15/384; 15/387; 15/388; 15/351; 15/352; 15/353

(58) Field of Classification Search ..... None
See application file for complete search history.

(56) References Cited

U.S. PATENT DOCUMENTS

| | | | |
|---|---|---|---|
| 3,668,734 | A | 6/1972 | Fairaizl et al. |
| 3,818,540 | A | 6/1974 | Martinec et al. |
| 4,097,950 | A | 7/1978 | Satterfield |
| 4,413,372 | A | 11/1983 | Berfield |
| 4,564,972 | A | 1/1986 | Varin |
| 5,392,490 | A | 2/1995 | Monson |
| 5,857,239 | A | 1/1999 | Oh et al. |
| 6,101,668 | A | 8/2000 | Grey |
| 6,494,772 | B1 | 12/2002 | Barnes et al. |

FOREIGN PATENT DOCUMENTS

| | | |
|---|---|---|
| EP | 0267056 | 5/1988 |
| JP | 2003125992 A | 5/2003 |

*Primary Examiner*—David Redding
(74) *Attorney, Agent, or Firm*—The Ollila Law Group LLC

(57) ABSTRACT

A vacuum cleaner attachment is provided. The vacuum cleaner attachment includes a chassis and a plurality of wheels. The chassis is adapted to roll on an underlying surface using the plurality of wheels. The vacuum cleaner attachment further includes a vacuum cleaner receptacle formed in the chassis and adapted to receive a vacuum cleaner and corresponding power brushroll. The vacuum cleaner attachment further includes a vacuum airflow conduit formed in the chassis and adapted to communicate a vacuum airflow of the vacuum cleaner through the chassis. The vacuum cleaner attachment further includes one or more rollers rotatably held in the chassis and positioned to receive rotational power from the power brushroll of the vacuum cleaner when the vacuum cleaner is positioned in the vacuum cleaner receptacle. The one or more rollers are positioned in the chassis to make contact with the underlying surface.

18 Claims, 3 Drawing Sheets

VACUUM CLEANER ATTACHMENT

TECHNICAL FIELD

The present invention relates to a vacuum cleaner attachment, and more particularly, to a vacuum cleaner attachment that fits to a vacuum cleaner and a powered brushroll of the vacuum cleaner.

BACKGROUND OF THE INVENTION

Vacuum cleaners generate a vacuum airflow in order to pick up dirt, debris, etc. Many vacuum cleaners include a powered brushroll. The powered brushroll is a cylindrical rotating brush that is rotated in order to agitate and propel dirt into the vacuum airflow. The powered brushroll can provide the vacuum cleaner with the ability to pick up larger objects than just the vacuum airflow alone, and can pick up objects embedded in carpeting or rough surfaces. The powered brushroll therefore improves the cleaning ability of the vacuum cleaner.

However, vacuum cleaners and powered brushrolls in the prior art have drawbacks. Prior art powered brushrolls are typically designed for cleaning carpeted floors. Therefore, their bristle length, stiffness, floor height, etc., are usually chosen for carpet cleaning. Prior art powered brushrolls therefore do not function well for cleaning hard surfaces or smooth surfaces. Although most prior art brushrolls may contact the underlying hard or smooth surface, the prior art brushrolls do not, in general, work well for cleaning surface imperfections, such as mars, scratches, seams, grout lines, linoleum features, low spots in hardwood floors (such as wood grain features), etc. In addition, the powered brushroll in the prior art is not useful for applying floor treatments, such as waxes, polishes, cleaners, etc., and is not useful for performing specialized cleaning tasks.

SUMMARY OF THE INVENTION

A vacuum cleaner attachment is provided according to an embodiment of the invention. The vacuum cleaner attachment comprises a chassis and a plurality of wheels rotatably held in the chassis. The chassis is adapted to roll on an underlying surface using the plurality of wheels. The vacuum cleaner attachment further comprises a vacuum cleaner receptacle formed in the chassis and adapted to receive a vacuum cleaner and corresponding power brushroll. The vacuum cleaner attachment further comprises a vacuum airflow conduit formed in the chassis and adapted to communicate a vacuum airflow of the vacuum cleaner through the chassis. The vacuum cleaner attachment further comprises one or more rollers rotatably held in the chassis and positioned to receive rotational power from the power brushroll of the vacuum cleaner when the vacuum cleaner is positioned in the vacuum cleaner receptacle. The one or more rollers are positioned in the chassis to make contact with the underlying surface.

A method of forming a vacuum cleaner attachment is provided according to an embodiment of the invention. The method comprises providing a chassis and providing a plurality of wheels rotatably held in the chassis. The chassis is adapted to roll on an underlying surface using the plurality of wheels. The method further comprises providing a vacuum cleaner receptacle formed in the chassis and adapted to receive a vacuum cleaner and corresponding power brushroll. The method further comprises providing a vacuum airflow conduit formed in the chassis and adapted to communicate a vacuum airflow of the vacuum cleaner through the chassis. The method further comprises providing one or more rollers rotatably held in the chassis and positioned to receive rotational power from the power brushroll of the vacuum cleaner when the vacuum cleaner is positioned in the vacuum cleaner receptacle. The one or more rollers are positioned in the chassis to make contact with the underlying surface.

BRIEF DESCRIPTION OF THE DRAWINGS

The same reference number represents the same element on all drawings. It should be noted that the drawings are not to scale.

DETAILED DESCRIPTION OF THE INVENTION

Figure 1:
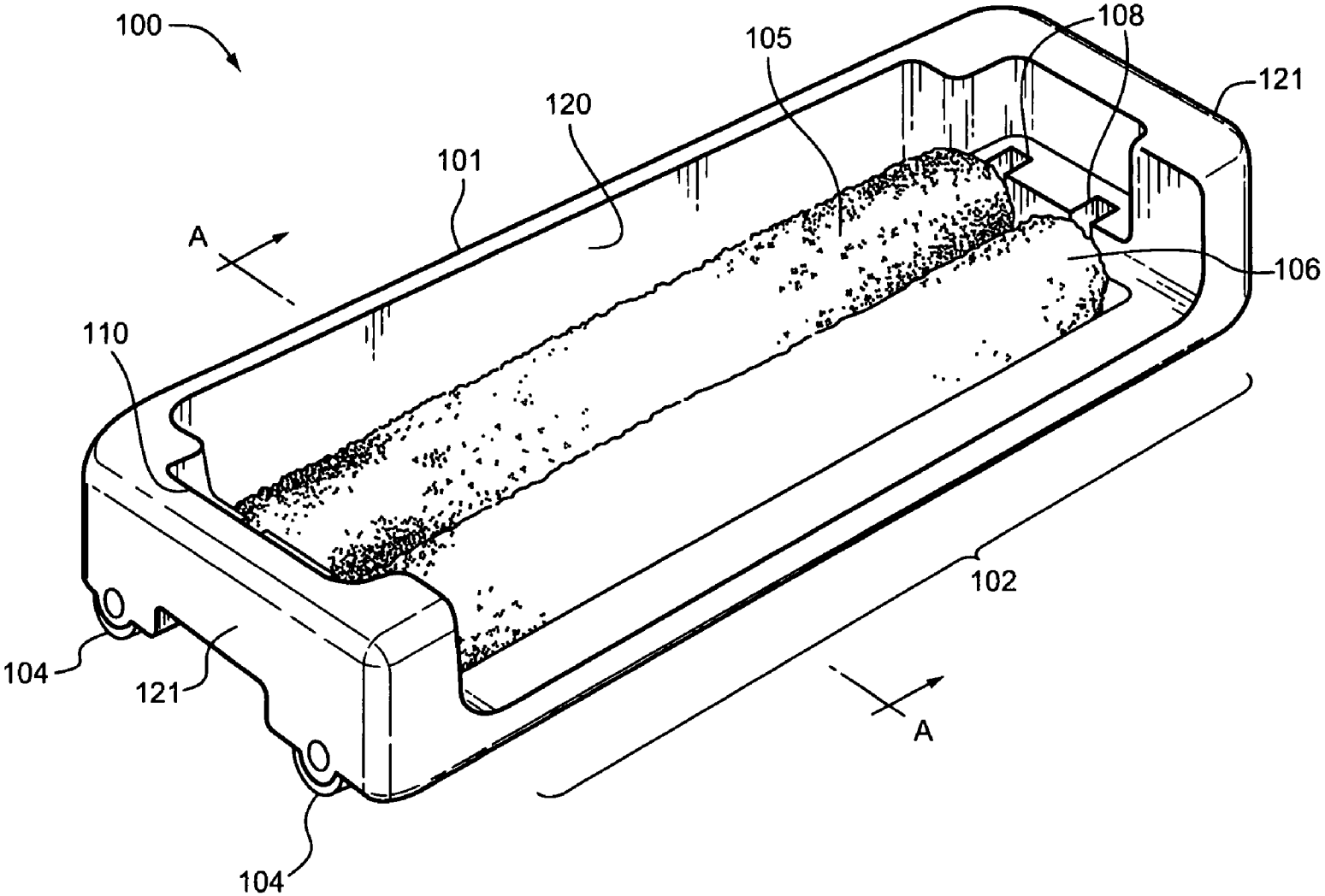
FIG. 1 shows a vacuum cleaner attachment according to an embodiment of the invention.

FIG. 1 shows a vacuum cleaner attachment 100 according to an embodiment of the invention. The vacuum cleaner attachment 100 includes a chassis 101, a vacuum cleaner receptacle 102, wheels 104, and one or more rollers, such as rollers 105 and 106, for example. The vacuum cleaner attachment 100 fits to a vacuum cleaner and powered brushroll of the vacuum cleaner. The vacuum cleaner attachment 100 can be attached to and removed from the vacuum cleaner. The vacuum cleaner attachment 100 can add specialized cleaning capabilities to the vacuum cleaner. The vacuum cleaner attachment 100 can be interchanged according to the cleaning task. In addition, the vacuum cleaner attachment 100 can be configured according to the cleaning task.

The vacuum cleaner receptacle 102 is formed in the chassis 101. The vacuum cleaner receptacle 102 is of a size and shape to receive a vacuum cleaner. The vacuum cleaner receptacle 102 receives and holds the vacuum cleaner. The vacuum cleaner can comprise an upright model or can comprise a canister model with a power head, for example. The vacuum cleaner receptacle 102 in the embodiment shown includes a front wall 120 and two side walls 121. In other embodiments, the vacuum cleaner receptacle 102 can include a rear wall (not shown). The various walls can be fixed, movable, flexible, adjustable, hinged, etc.

Figure 2:
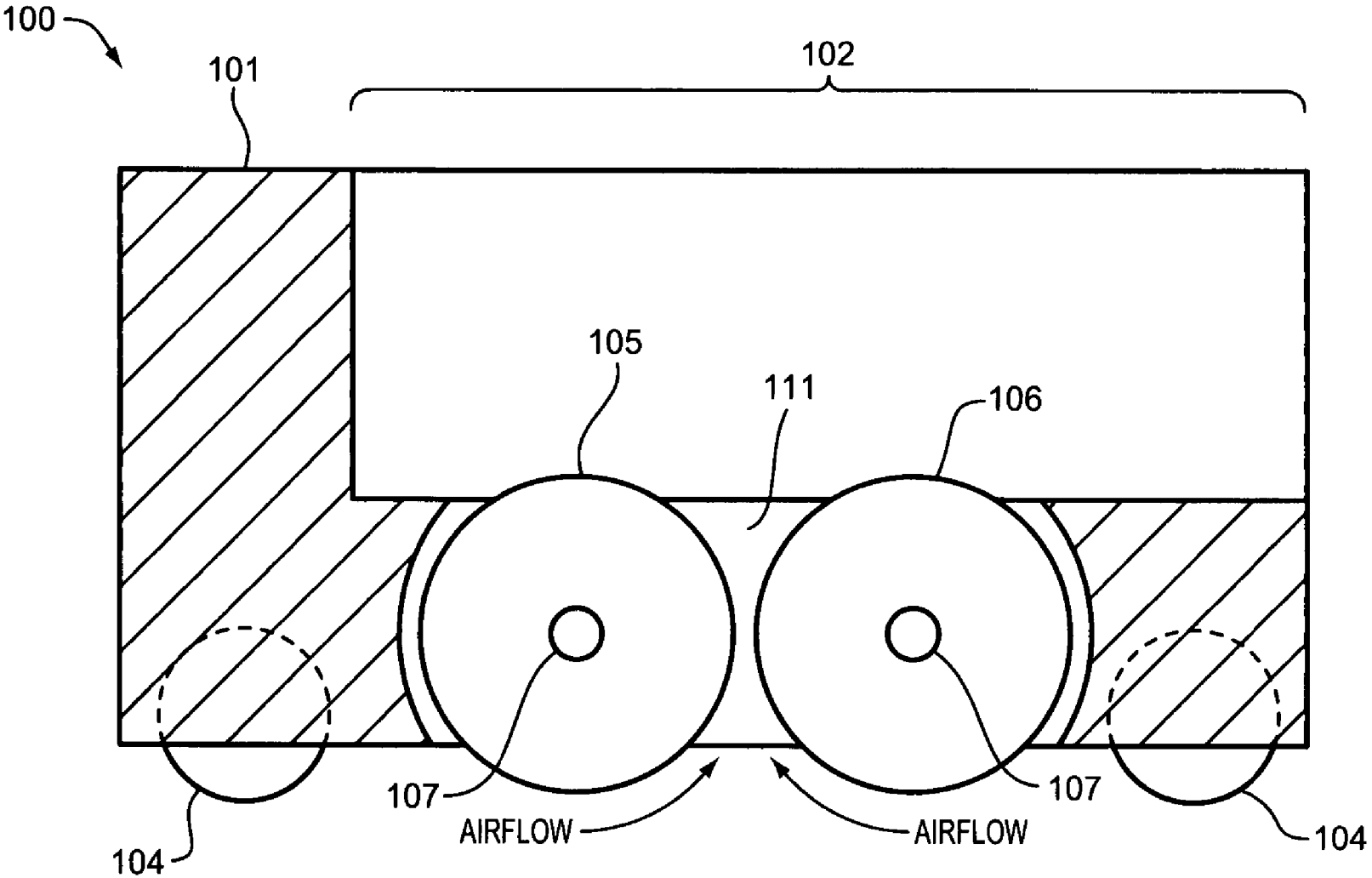
FIG. 2 is a section view of the vacuum cleaner attachment along the line AA of FIG. 1.

FIG. 2 is a section view of the vacuum cleaner attachment 100 along the line AA of FIG. 1. In addition to the previously recited components, the figure shows a vacuum airflow conduit 11 formed in the chassis 101. The vacuum airflow conduit 11 communicates a vacuum airflow of the vacuum cleaner through the chassis 101. The one or more rollers, such as the rollers 105 and 106, are positioned in the vacuum airflow conduit 111. FIG. 2 shows how the vacuum airflow generated by the vacuum cleaner is allowed to pass through the vacuum airflow conduit 111 of the vacuum cleaner attachment 100.

In addition, the figure shows the placement of the rollers 105 and 106 according to one embodiment of the invention. The rollers 105 and 106 extend below the chassis 101 and contact the underlying surface. The amount of contact of the rollers 105 and 106 with the underlying surface is controlled by the size of the rollers, by the positioning of the rollers in the chassis 101, and by the positioning of the wheels 104 in the chassis 101.

Figure 3:
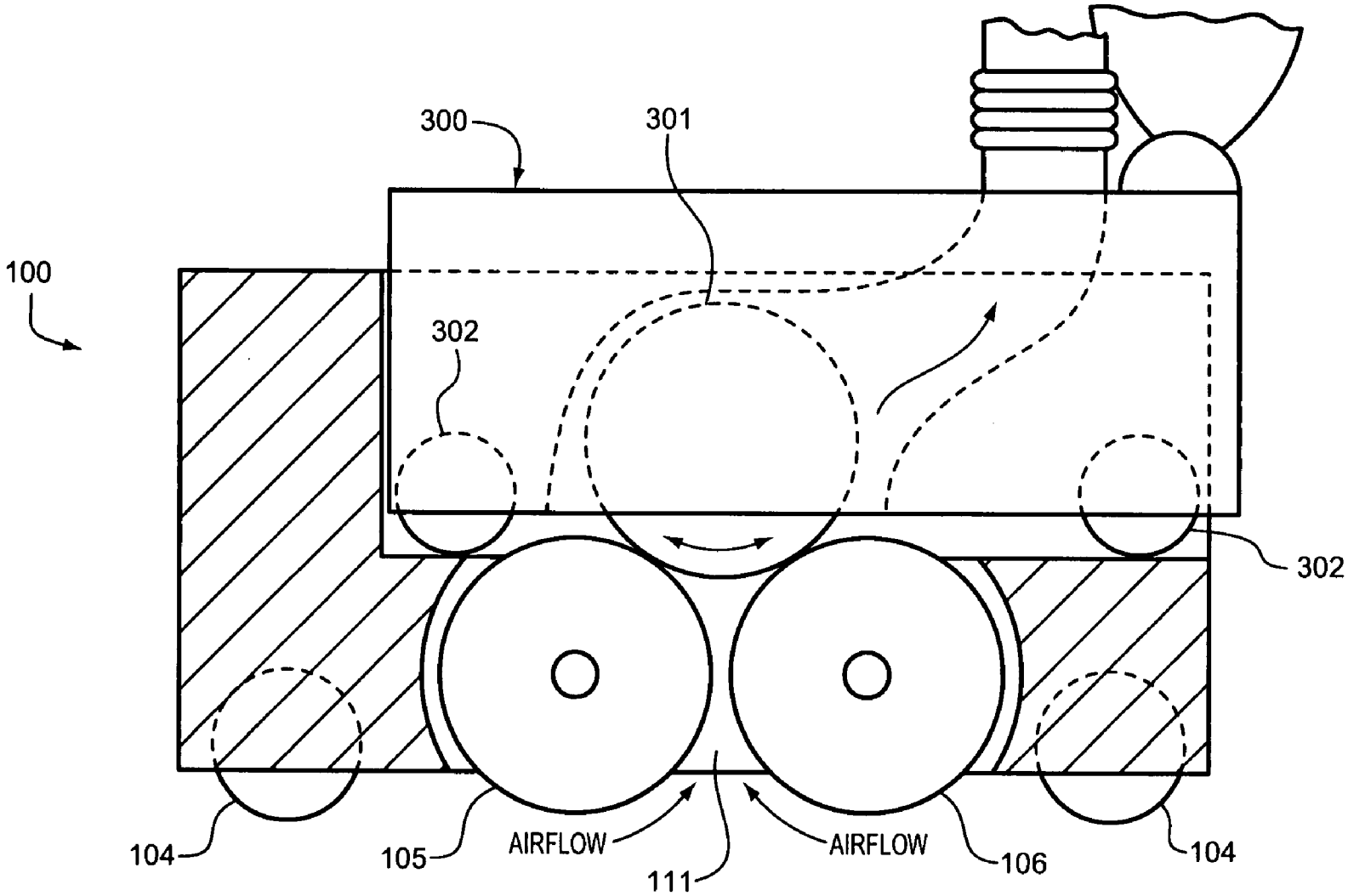
FIG. 3 shows the vacuum cleaner attachment with a vacuum cleaner positioned in the vacuum cleaner receptacle.

FIG. 3 shows the vacuum cleaner attachment 100 with a vacuum cleaner 300 positioned in the vacuum cleaner receptacle 102. In operation, a vacuum cleaner is placed on the vacuum cleaner attachment 100 and positioned in the vacuum cleaner receptacle 102. The vacuum cleaner receptacle 102 receives and holds the vacuum cleaner 300. A powered brushroll 301 of the vacuum cleaner 300 contacts the rollers 105 and 106 and imparts rotational power to the rollers 105 and 106. In addition, the vacuum cleaner attachment 100 allows the vacuum airflow generated by the vacuum cleaner 300 to pass through the chassis 101, around the rollers 105 and 106 via the vacuum airflow conduit 111. In this manner, the vacuum cleaner attachment 100 functions as a new or replacement vacuum cleaner head, including a powered brushroll or brushrolls.

The rollers 105 and 106 are used to clean the underlying surface. For example, a first roller, such as roller 105, can agitate and propel large particles of dirt and debris into the vacuum airflow generated by the vacuum cleaner 300. A second roller, such as roller 106, can pick up small particles, such as dust, etc. Alternatively, the second roller can be used to apply treatments to the underlying surfaces, such as cleaners, waxes or polishes, etc.

The rollers 105 and 106 can comprise special purpose rollers. For example, the first roller 105 can comprise a scrubbing roller and the second roller 106 can comprise a liquid absorbent roller. In another example, the first roller 105 can comprise an agitator roller and the second roller 106 can comprise a liquid applicator roller. In yet another example, the first roller 105 can comprise a rough cleaning roller and the second roller 106 can comprise a smooth treatment roller.

The vacuum cleaner attachment 100 can include several optional features. The number of rollers is optional. For example, the vacuum cleaner attachment 100 can include one roller, two rollers, as shown, three rollers, etc.

The vacuum cleaner attachment 100 can include removable rollers. As a result, the user can pick an appropriate roller or rollers for the underlying surface to be cleaned. For a removable roller embodiment, the chassis 101 can include channels 108 (see FIG. 1) that receive spindle ends 107 of the rollers (see FIG. 2).

The vacuum cleaner attachment 100 can include any number of wheels 104. The vacuum cleaner attachment 100 is free to roll on an underlying surface due to the wheels 104. In the embodiment shown, the vacuum cleaner attachment 100 includes four wheels. Four wheels 104 may be the most stable and preferable wheel configuration. However, other numbers of wheels can be employed.

In another optional feature, the chassis 101 includes one or more apertures that allow one or more corresponding drive wheels of the vacuum cleaner to contact one or more wheels of the vacuum cleaner attachment 100. As a result, the wheels 104 of the vacuum cleaner attachment 100 can receive rotational power from the drive wheels of a self-propelled vacuum cleaner. The wheels 104 can be powered in forward and backward directions. In addition, the wheels 104 on opposite sides of the vacuum cleaner attachment 100 can be powered in opposite directions during turning or pivoting maneuvers.

In another optional feature, the vacuum cleaner attachment 100 can include wheel depressions that receive and hold corresponding wheels 302 of the vacuum cleaner. The wheel depressions therefore operate to retain the vacuum cleaner in the vacuum cleaner attachment 100. In the case of a self-propelled vacuum cleaner, the wheel depressions can be oversized, so that the power wheels of the vacuum cleaner can rotate freely without contacting the chassis. This can be done so that a self-propelled vacuum cleaner does not move in the vacuum cleaner receptacle 102.

The vacuum cleaner attachment 100 can include one or more restraining members (not shown) that can be used to retain the vacuum cleaner in the vacuum cleaner receptacle 102. The one or more restraining members removably attach the vacuum cleaner to the vacuum cleaner attachment 100. The one or more restraining members can comprise any manner of straps, brackets, bars, springs or spring clips, frictional fit devices such as bumps or tabs, etc. In one embodiment, the one or more restraining members comprise one or more hood and loop (such as VELCRO) straps.

The vacuum cleaner attachment 100 according the invention can provide benefits according to the various embodiments. The vacuum cleaner attachment 100 provides a detachable device that includes one or more rollers. The rollers can be specialized rollers for various applications and for various underlying surfaces. The rollers can be removable rollers, wherein a user can select specific rollers for a particular application. The rollers are held in a predetermined position with respect to the underlying surface. The rollers can be rotated by the power brushroll 301 of the vacuum cleaner 300. The vacuum cleaner attachment 100 can be designed to accept various vacuum cleaners. The vacuum cleaner attachment 100 according to any of the various embodiments therefore makes a vacuum cleaner a more flexible and versatile cleaning device.

What is claimed is:

1. A vacuum cleaner attachment, the vacuum cleaner attachment comprising:

a chassis;

a plurality of wheels rotatably held in the chassis, wherein the chassis is adapted to roll on an underlying surface using the plurality of wheels;

a vacuum cleaner receptacle formed in the chassis and adapted to receive a vacuum cleaner and corresponding power brushroll;

a vacuum airflow conduit formed in the chassis and adapted to communicate a vacuum airflow of the vacuum cleaner through the chassis; and one or more rollers rotatably held in the chassis and positioned to receive rotational power from the power brushroll of the vacuum cleaner when the vacuum cleaner is positioned in the vacuum cleaner receptacle, and with the one or more rollers being positioned in the chassis to make contact with the underlying surface.

2. The vacuum cleaner attachment of claim 1, wherein the one or more rollers comprise two rollers.

3. The vacuum cleaner attachment of claim 1, wherein the one or more rollers are removable from the chassis.

4. The vacuum cleaner attachment of claim 1, wherein the plurality of wheels comprise four wheels.

5. The vacuum cleaner attachment of claim 1, wherein the one or more rollers comprise two rollers, with a first roller comprising a scrubbing roller and with a second roller comprising a liquid absorbent roller.

6. The vacuum cleaner attachment of claim 1, wherein the one or more rollers comprise two rollers, with a first roller comprising an agitator roller and with a second roller comprising a liquid applicator roller.

7. The vacuum cleaner attachment of claim 1, wherein the one or more rollers comprise two rollers, with a first roller comprising a rough cleaning roller and with a second roller comprising a smooth treatment roller.

8. The vacuum cleaner attachment of claim 1, further comprising one or more restraining members that removably affix the vacuum cleaner attachment to the vacuum cleaner.

9. The vacuum cleaner attachment of claim 1, further comprising one or more apertures in the chassis, with the one or more apertures allowing one or more corresponding drive wheels of the vacuum cleaner to contact one or more wheels of the plurality of wheels and impart rotational power to the one or more wheels.

10. A method of forming a vacuum cleaner attachment, the method comprising:

providing a chassis;

providing a plurality of wheels rotatably held in the chassis, wherein the chassis is adapted to roll on an underlying surface using the plurality of wheels;

providing a vacuum cleaner receptacle formed in the chassis and adapted to receive a vacuum cleaner and corresponding power brushroll;

providing a vacuum airflow conduit formed in the chassis and adapted to communicate a vacuum airflow of the vacuum cleaner through the chassis; and providing one or more rollers rotatably held in the chassis and positioned to receive rotational power from the power brushroll of the vacuum cleaner when the vacuum cleaner is positioned in the vacuum cleaner receptacle, and with the one or more rollers being positioned in the chassis to make contact with the underlying surface.

11. The vacuum cleaner attachment of claim 10, wherein the one or more rollers comprise two rollers.

12. The vacuum cleaner attachment of claim 10, wherein the one or more rollers are removable from the chassis.

13. The vacuum cleaner attachment of claim 10, wherein the plurality of wheels comprise four wheels.

14. The vacuum cleaner attachment of claim 10, wherein the one or more rollers comprise two rollers, with a first roller comprising a scrubbing roller and with a second roller comprising a liquid absorbent roller.

15. The vacuum cleaner attachment of claim 10, wherein the one or more rollers comprise two rollers, with a first roller comprising an agitator roller and with a second roller comprising a liquid applicator roller.

16. The vacuum cleaner attachment of claim 10, wherein the one or more rollers comprise two rollers, with a first roller comprising a rough cleaning roller and with a second roller comprising a smooth treatment roller.

17. The vacuum cleaner attachment of claim 10, further comprising providing one or more restraining members that removably affix the vacuum cleaner attachment to the vacuum cleaner.

18. The vacuum cleaner attachment of claim 10, further comprising providing one or more apertures in the chassis, with the one or more apertures allowing one or more corresponding drive wheels of the vacuum cleaner to contact one or more wheels of the plurality of wheels and impart rotational power to the one or more wheels.

* * * * *